US005679933A

United States Patent [19]

Weber et al.

[11] Patent Number: 5,679,933

[45] Date of Patent: Oct. 21, 1997

[54] CONTROL PANELS FOR ELEVATORS

[75] Inventors: Robert Weber, Velpke; Ralf Schmidt, Gifhorn, both of Germany

[73] Assignee: Weber Steuerungstechnik GmbH, Velpke, Germany

[21] Appl. No.: 539,633

[22] Filed: Oct. 5, 1995

[30] Foreign Application Priority Data

Oct. 6, 1994 [DE] Germany ..... 44 35 740
Oct. 21, 1994 [DE] Germany ..... 9416959 U

[51] Int. Cl.[6] ..... B66B 1/34

[52] U.S. Cl. ..... 187/395; 187/389; D25/37

[58] Field of Search ..... 187/395, 396, 187/414, 901, 380, 384, 389; D25/37; D39/33

[56] References Cited

U.S. PATENT DOCUMENTS 1,893,332 1/1933 Lind ..... 187/380
3,342,289 9/1967 Gingrich et al. ..... 187/380

FOREIGN PATENT DOCUMENTS 1-288584 11/1989 Japan ..... 187/395
82/02704 8/1982 WIPO ..... 187/395

*Primary Examiner*—Robert Nappi
*Attorney, Agent, or Firm*—Whitham, Curtis, Whitham & McGinn

[57] ABSTRACT

An elevator control panel is provided with a means for selecting a destination among a plurality of destinations for the passenger using a minimum number of input devices.

16 Claims, 2 Drawing Sheets

CONTROL PANELS FOR ELEVATORS

BACKGROUND OF THE INVENTION

1. Field of the Invention

The invention is generally related to a control panel for an elevator or similar device.

2. Description of the Prior Art

Elevators are used to vertically transport people or goods, particularly in high buildings comprising a plurality of stories. Control panels are provided near the entrance in each storey and in the passenger cabin. While the control panels beside the entrance in every storey often simply comprise one or two push buttons to request stopping of the elevator and to indicate that a passenger is waiting for the passenger cabin wanting to travel either up or downwards, the control panel in the passenger cabin needs to provide for the possibility to indicate the destination, i.e., the floor on which the passenger wants to exit.

Common control panels comprise a single button for each storey. The button can be of the push button type of the tough button type. The disadvantage of this technique is that, particularly in high buildings, many push buttons or touch buttons must be provided, resulting for example in the problem that the buttons cannot be arranged in a manner that passengers of all considerable different heights can reach all buttons in a convenient manner. So it often happens that short people have difficulties reaching the buttons pertaining to high stories, while tall people have to bend down to reach for the buttons pertaining to the lower stories.

Also, known elevators sometimes feature locks to be used with a normal key, these locks allowing or denying access to certain floors. A disadvantage of this technique is that an additional key has to be handled and stored by all people wanting to have access to the concerned floor.

Furthermore, the control panels have to be custom designed for each building, because not all office buildings comprise the same number of stories.

Furthermore, it has turned out to be a disadvantage that in most elevator systems the users wish on which floor to stop can only be entered in the passenger cabin itself by the control panel mounted therein. For smoother controlling of the elevator, particularly during peaks of passenger numbers, e.g., during lunch time, it would be desirable to have a control panel available that can be located on each floor near the entrance of the elevator, to enable potential passengers to indicate at an earlier time on which floor they want to exit. In such a manner the rides of the passenger cabin could be organized and controlled more efficiently. Since conventional control panels with their high number of buttons are apparently not suitable for such task, external entering of destinations is not realized.

SUMMARY OF THE INVENTION

One object of this invention is to develop a control panel for an elevator which allows a user to select or program a destination among a big plurality of possible destinations, whereby the dimensions of said control panel can be kept small and the control panel can more easily be operated by passengers.

Another object of the invention is to facilitate production of a control panel for elevators, and reducing costs by creating the possibility to use the same control panel in buildings with different numbers of stories.

In accomplishing the aforementioned objects there as been provided a control panel for elevator or the like, with a hand operated means for selecting a destination among a plurality of possible destinations, said means being continuously movable in at least two directions, each representing either an ascending or a descending numerical order of destinations, and a means for entering a command on the basis of said selected destination.

In a preferred embodiment, the control panel comprises a rotary type control knob as a means for selecting the destination and a push button as a means for entering a command.

In an even more preferred embodiment the rotary type control knob is ring-like shaped, while said push button is arranged concentrically in that ring. Such, a very compact control panel can be designed, allowing for selecting a nearly indefinite number of destinations, i.e., floors.

Alternatively the means for selecting the destination can have at least two distinct operational directions, whereby an operational direction does not necessarily need to be a mechanical direction. For example, one could use two electrical switches, e.g., push buttons or touch buttons, each representing one of two operational directions, each of said two directions representing either an ascending or descending numerical order of destinations. By actuating one of the two switches, e.g., a touch button, the reference numeral designating the selected designation starts changing in an ascending or descending order. Also, the two operational directions of said means for selecting can be realized in the form of a rocker button.

An alternative embodiment features a track ball as a means of selection. In both cases, a display can be provided, said display indicating the reference numeral of the picked destination, e.g., "112", if the passenger wants to exit on floor 112.

Furthermore, the display can be used to give instructions to a passenger, to acknowledge receipt of a command or to indicate errors.

Furthermore, an acoustic device can be included to acknowledge an entered command, for example by a beep or by a synthetic human voice saying "one hundred and twelve".

Last, but not least, the control panel can also be used to enter a multi digit password, thereby blocking or allowing access to certain floors.

BRIEF DESCRIPTION OF THE DRAWINGS

The foregoing and other objects, aspects and advantages will be better understood from the following detailed description of the preferred embodiments of the invention with reference to the drawings, in which.

DETAILED DESCRIPTION OF THE PREFERRED EMBODIMENTS OF THE INVENTION

Figure 1:
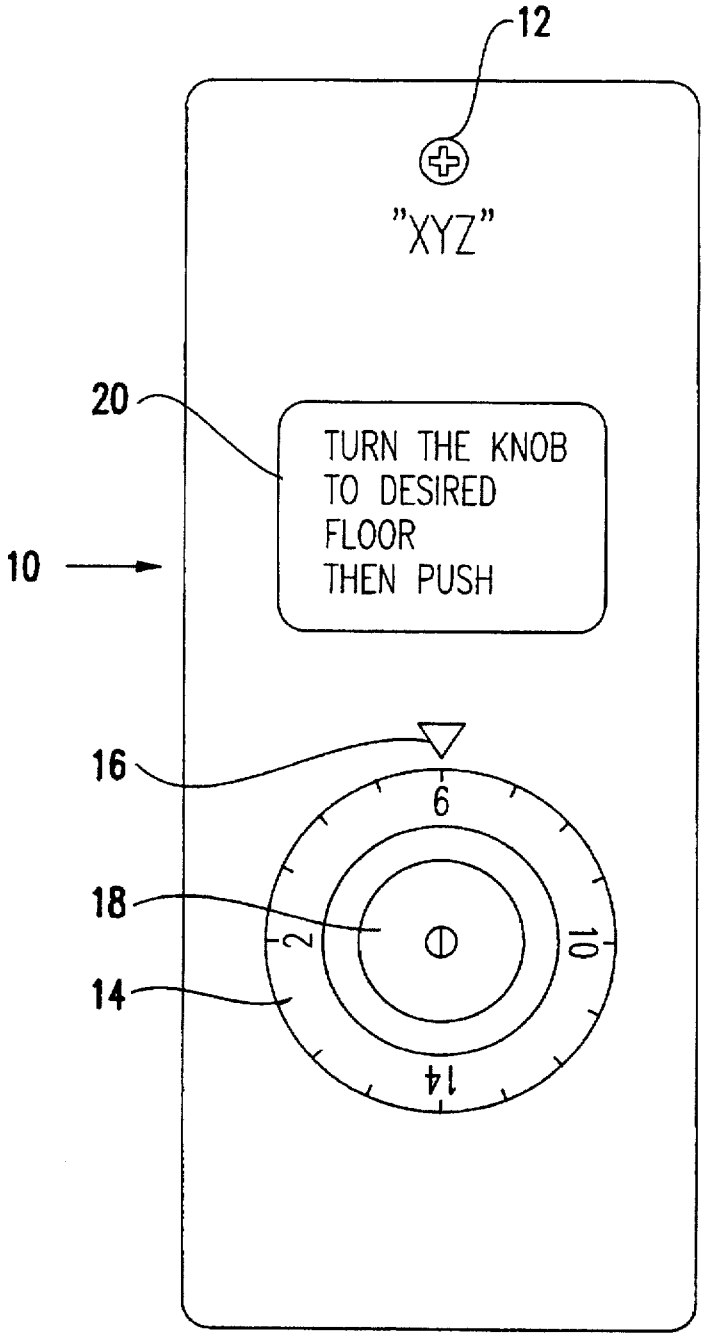
FIG. 1 is a front view of a control panel according to the invention.
Figure 2:
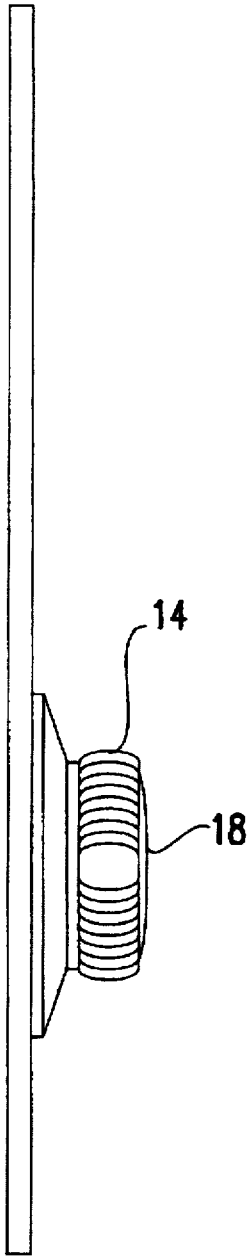
FIG. 2 is a side view of the control panel shown in FIG. 1.

FIG. 1 shows a control panel 10 according to the invention. The control panel 10 can be mounted with a screw 12 in a cavity of a wall of a passenger cabin of an elevator. A rotary type control knob 14 is provided having essentially ring-like or torus-like shape. An arrow 16 indicates the position of knob 14. Knob 14 can be rotated clockwise or counter-clockwise in a locking manner, i.e., slightly locking in each position representing a certain floor, indicated by the numbers engraved on said ring or torus.

Located in a concentrical manner within knob 14 is a push button 18.

A display 20 informs a passenger entering into the passenger cabin "turn the knob to desired floor, then push".

After turning the knob 14 to the desired floor and pushing push button 18, the display 20 acknowledges safe receipt of that command by indicating the reference numeral of the floor selected, e.g., "6".

The inventive control panel can be adjusted at a height that can be reached in a convenient manner for people of all different heights.

Figure 3:
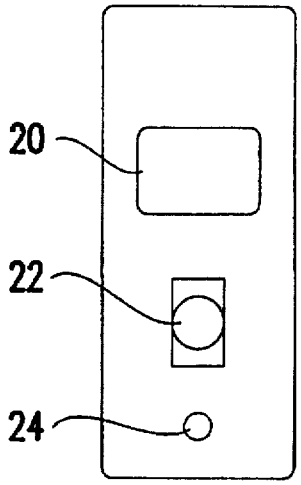
FIGS. 3–7 show front views of alternative control panels according to the invention.

It should be understood that the basic concept of entering a command at a control panel for an elevator in a multistory building without requiring a plurality of buttons may advantageously be performed by a number of other techniques. For example, FIG. 3 shows a rocker button 22 used to select floor destinations. By moving the rocker button 22 upwards the floor numbers sequentially appear in ascending order on display 20. By moving the rocker button 22 downwards, the floor numbers sequentially appear in descending order on display 20. Once the desired floor is indicated on display 20, the rocker button is returned to a central location. The floor can be "selected" by either depressing a button 24, or by depressing the rocker button 22, or simply be providing a time out feature which will automatically enter the designated floor after a period of time after the rocker button 22 ceases to be operated.

Figure 4:
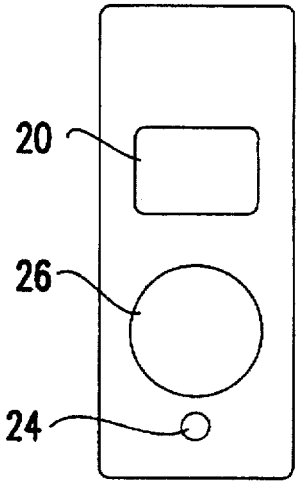

FIG. 4 shows a variation on the control panel of FIG. 3, wherein a trackball 26 is rotated upward or downward to cause the floor destination numbers to appear in ascending or descending order on display 20. As discussed in connection with FIG. 3, the selection criteria can be entered by depressing button 24 or by using a time out feature that automatically enters a floor destination after a user stops operating the track ball 26.

Figure 5:
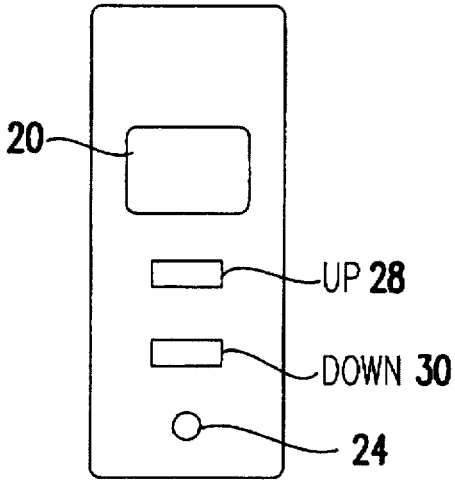

FIG. 5 shows another variation on FIG. 3, wherein an operator uses up and down push-button switches 28 and 30, respectively, to have ascending and descending floors appear in display 20. As discussed in connection with FIG. 3, the selection criteria can be entered by depressing button 24 or by using a time out feature that automatically enters a floor destination after a user stops operating the switches 28 or 30.

Figure 6:
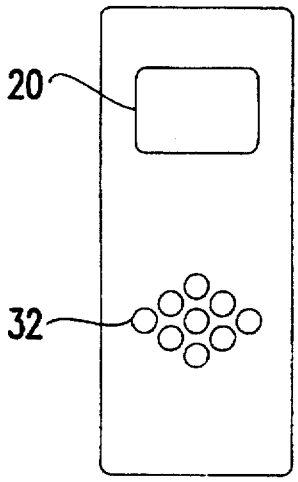
Figure 7:
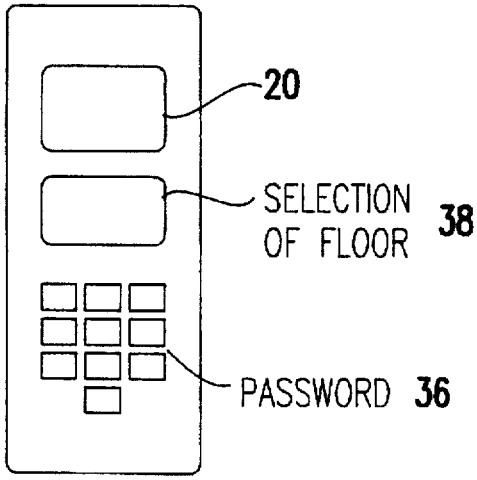

FIG. 6 shows an embodiment where the selection of floors is voice activated. A user simply says his desired floor destination into receiver 32. The voice input is recognized, and is then used to automatically indicate instructions to the passenger cabin control. In this embodiment, a display 20 may not be required. Furthermore, while the above embodiments indicate that the display 20 provides selected floor information, it should be understood that other information can also be provided on the displays 20, such as input errors, "out of service" warnings, etc.

FIG. 8 shows an embodiment of the invention where a user must enter a password, preferably using keypad 36, in order to be able to select a floor destination using floor selector control 38. People without proper password identification will be denied access to any of a plurality of selected floors. The floor selector can be any of those shown in FIGS. 1–7. In the case of a voice activated system such as that shown in FIG. 6, the password may be input by voice command instead of a keypad 36.

While the invention has been described in terms of its preferred embodiments, those skilled in the art will recognize that the invention can be practiced with modification within the spirit and scope of the appended claims.

We claim:

1. A control panel for an elevator or the like, with a hand operated means for selecting a destination floor among a plurality of possible destination floors, said hand operated means having at least two distinct operational directions, each representing either an ascending or descending order of destination floors and sequentially presenting each of said destination floors for selection, and a means for entering a command on the basis of said selected destination floor.

2. The control panel of claim 1, whereby said means is movable in at least two directions, each representing either an ascending or a descending numerical order of destinations.

3. Control panel for an elevator or the like, with a hand operated means for selecting a destination among a plurality of possible destinations, said means being continuously movable in at least two directions, each representing either an ascending or a descending numerical order of destinations, and a means for entering a command on the basis of said selected destinations, wherein said means for selecting a destination is a rotary type control knob and said means for entering is a push button.

4. The control panel of claim 3 wherein said rotary type control knob has a geometrical form of a ring and said push button is arranged concentrical within said ring.

5. The control panel of claim 1, wherein each of said two distinct operational directions is realized in the form of an electrical switch, operation of said electrical switch causing a selected destination floor to change to a next lower or higher destination floor.

6. Control panel for an elevator or the like, with a hand operated means for selecting a destination among a plurality of destinations, said means being continuously movable in a least two directions, each representing either an ascending or a descending numerical order of destinations, and a means for entering a command on the basis of said selected destination, wherein said means for selecting a destination is a track ball.

7. The control panel of claim 1 wherein said control panel comprises an optical display for showing the reference number of the selected destination floor.

8. The control panel of claim 6 wherein said control panel comprises an optical display for showing the reference numeral of the selected destination.

9. The control panel of claim 1, further comprising an acoustic device for acknowledgment of a command entered into said control panel.

10. The control panel of claim 6, further comprising an acoustic device for acknowledgment of a command entered into said control panel.

11. The control panel of claim 3 wherein said means for selecting a destination can also be used as a means for entering a password.

12. An elevator control panel, comprising:

means for selecting a destination floor amongst a plurality of destination floors, said means for selecting comprising a means to sequentially move through each of said plurality of destination floors in an ascending and a descending order until said destination is indicated by said display; and means for entering a command pertaining to said destination floor based on a selection made by said means for selecting.

13. The elevator control panel of claim 12 wherein said means to sequentially move through said plurality of destination floors in an ascending and a descending order until said destination floor is indicated by said display is selected from the group consisting of a track ball, a rocker button, and a pair of up and down switches.

14. An elevator control panel, comprising:

means for selecting a destination amongst a plurality of destinations, said means for selecting comprising a display and a means to sequentially move through said plurality of destinations in an ascending and a descending order until said destination is indicated by said display wherein said means to sequentially move through said plurality of destinations in an ascending and a descending order until said destination is indicated by said display comprises a rotary knob which can rotate both clockwise and counter-clockwise, and wherein said display comprises indicia positioned on said rotary knob, and a means for identifying a destination positioned adjacent said rotary knob in alignment with said indicia; and means for entering a command pertaining to said destination based on a selection mady by said means for selecting.

15. An elevator control panel, comprising:

means for selecting a destination amongst a plurality of destinations, said means for selecting comprising a display and a means to sequentially move through said plurality of destinations in an ascending and a descending order until said destination is indicated by said display;

means for entering a command pertaining to said destination based on a selection mady by said means for selecting; and a means for entering a password, and wherein said means for selecting a destination is selectively enabled or disengaged in response to said password.

16. The elevator control panel of claim 12 further comprising an acoustic device for acknowledging a command made by said means for entering a command.

* * * * *